US005653790A

United States Patent [19]

Fotinos et al.

[11] Patent Number: 5,653,790

[45] Date of Patent: Aug. 5, 1997

[54] ZINC PHOSPHATE TUNGSTEN-CONTAINING COATING COMPOSITIONS USING ACCELERATORS

[75] Inventors: Nicephoros A. Fotinos, Troy; Donald R. Vonk, Clinton Township, Macomb County, both of Mich.; Ralph C. Gray, Butler, Pa.

[73] Assignee: PPG Industries, Inc., Pittsburgh, Pa.

[21] Appl. No.: 603,046

[22] Filed: Feb. 16, 1996

Related U.S. Application Data

[63] Continuation-in-part of Ser. No. 344,441, Nov. 23, 1994.

[51] Int. Cl.[6] ..... C23C 22/07

[52] U.S. Cl. ..... 106/14.12; 106/14.41; 106/14.42; 106/14.44; 148/259; 148/260

[58] Field of Search ..... 148/259, 260; 106/14.12, 14.41, 14.42, 14.44

[56] References Cited

U.S. PATENT DOCUMENTS

| | | | |
|---|---|---|---|
| 2,298,280 | 10/1942 | Clifford et al. | 148/260 |
| 2,743,204 | 4/1956 | Russell | 148/260 |
| 2,874,081 | 2/1959 | Cavanagh et al. | 148/254 |
| 2,884,351 | 4/1959 | Cavanagh et al. | 148/260 |
| 3,637,533 | 1/1972 | Dahill, Jr. | 252/522 |
| 3,867,506 | 2/1975 | Skarbo et al. | 423/139 |
| 3,907,966 | 9/1975 | Skarbo | 423/139 |
| 3,923,554 | 12/1975 | Ziemba | 148/260 |
| 3,975,214 | 8/1976 | Kulick et al. | 148/257 |
| 4,003,761 | 1/1977 | Getta et al. | 148/259 |
| 4,029,704 | 6/1977 | Anderson | 564/329 |
| 4,108,817 | 8/1978 | Lochel, Jr. | 148/251 |
| 4,149,909 | 4/1979 | Hamilton | 148/260 |
| 4,186,035 | 1/1980 | Cawley et al. | 148/249 |
| 4,292,096 | 9/1981 | Murakami et al. | 148/262 |
| 4,335,243 | 6/1982 | Michne | 546/97 |
| 4,338,141 | 7/1982 | Senzaki et al. | 148/262 |
| 4,389,260 | 6/1983 | Hauffe et al. | 148/262 |
| 4,433,015 | 2/1984 | Lindert | 148/251 |
| 4,457,790 | 7/1984 | Lindert et al. | 148/247 |
| 4,673,444 | 6/1987 | Saito et al. | 148/264 |
| 4,725,320 | 2/1988 | Tury et al. | 148/273 |
| 4,793,867 | 12/1988 | Charles et al. | 148/262 |
| 4,838,957 | 6/1989 | Miyamoto et al. | 148/260 |
| 4,865,653 | 9/1989 | Kramer | 204/38.1 |
| 5,039,363 | 8/1991 | Jo et al. | 148/260 |
| 5,176,843 | 1/1993 | Dalton et al. | 252/184 |
| 5,219,481 | 6/1993 | Lawson | 106/14.15 |
| 5,221,370 | 6/1993 | Jo et al. | 148/250 |
| 5,312,491 | 5/1994 | Binter | 148/272 |

FOREIGN PATENT DOCUMENTS

| | | |
|---|---|---|
| 0 125 025 | 11/1984 | European Pat. Off. . |
| 0 315 059 | 10/1987 | European Pat. Off. . |
| 0 403 241 | 9/1994 | European Pat. Off. . |
| 1 294 077 | 4/1962 | France . |
| 1 222 351 | 8/1966 | Germany . |
| 57-054279 | 3/1982 | Japan . |

*Primary Examiner*—Anthony Green
*Attorney, Agent, or Firm*—Kenneth J. Stachel

[57] ABSTRACT

Zinc phosphate aqueous coating compositions containing tungsten and using an accelerator which is an oxime, hydroxylamine sulfate or a mixture thereof are disclosed. The accelerators are environmentally friendly and stable in the acidic environment of zinc phosphate coating compositions so as to enable formation of a one-package system. The tungsten component avoids the use of nickel or cobalt ions in the compositions which are environmentally objectionable.

33 Claims, No Drawings

ZINC PHOSPHATE TUNGSTEN-CONTAINING COATING COMPOSITIONS USING ACCELERATORS

CROSS-REFERENCE TO RELATED APPLICATION

The present application is a continuation-in-part of application Ser. No. 08/344,441, filed Nov. 23, 1994, in the names of Donald R. Vonk and Jeffrey A. Greene, entitled "Zinc Phosphate Coating Compositions Containing Oxime Accelerators", and assigned to the assignee of the present invention, the contents of which are incorporated herein.

FIELD OF THE INVENTION

The present invention relates to an aqueous acidic zinc phosphate coating composition containing tungsten and stable accelerators; to a concentrate for preparing such compositions; to a process for forming a zinc phosphate coating on a metal substrate using such compositions and to the resultant coated metal substrate.

BACKGROUND OF THE INVENTION

The formation of a zinc phosphate coating also known as a zinc phosphate conversion coating on a metal substrate is beneficial in providing corrosion resistance and also in enhancing the adherence of paint to the coated metal substrate. Zinc phosphate coatings are especially useful on substrates which comprise more than one metal, such as automobile bodies or parts, which typically include steel, zinc coated steel, aluminum, zinc and their alloys. The zinc phosphate coatings may be applied to the metal substrate by dipping the metal substrate in the zinc phosphate coating composition, spraying the composition onto the metal substrate, or using various combinations of dipping and spraying. It is important that the coating be applied completely and evenly over the surface of the substrate and that the coating application not be time or labor intensive.

The zinc phosphate coating compositions are acidic and contain zinc ion and phosphate ion, as well as additional ions, such as nickel and/or cobalt ion, depending upon the particular application. The presence of nickel ions or cobalt ions in such zinc phosphate coating compositions can be objectionable from an environmental standpoint since such ions are hazardous and difficult to remove from wastewater from commercial applications.

In addition, accelerators are often used in such zinc phosphate compositions. A typical accelerator is nitrite ions, provided by the addition of a nitrite ion source such as sodium nitrite, ammonium nitrite, or the like to the zinc phosphate coating composition. Nitrites, however, are not stable in the acidic environment of the zinc phosphate coating composition and decompose to nitrogen oxides which are hazardous air pollutants and which do not exhibit accelerating capability. Therefore, stable one-package coating compositions cannot be formulated; rather the nitrites must be added to the zinc phosphate coating composition shortly before use. Another disadvantage of the nitrite accelerators is that they provide by-products that cause waste treatment problems upon disposal of the spent zinc phosphating solution. It would be desirable to have an accelerator which is stable in the acidic environment of the zinc phosphate coating composition and which is environmentally acceptable.

It is an object of the present invention to provide a zinc phosphate coating composition that avoids the use of nickel and/or cobalt and which still provides excellent coating properties and is stable in an acidic environment of a zinc phosphating solution.

It is another object of the present invention to provide a zinc phosphate coating composition that includes accelerating agents which provide excellent coating properties, are stable in that they will not decompose in the acidic environment of a zinc phosphating solution and which are environmentally acceptable.

SUMMARY OF THE INVENTION

The present invention provides an aqueous acidic composition for forming a zinc phosphate, tungsten-containing coating on a metal substrate comprising about 0.4 to 3.0 grams per liter (g/l) of zinc ion, about 4 to 20 g/l phosphate ion, about 0.005 to 10.0 g/l tungsten and as an accelerator, about 0.5 to 20 g/l of an oxime, hydroxylamine sulfate, or mixtures thereof.

The present invention also provides for an aqueous acidic concentrate which upon dilution with aqueous medium forms an aqueous acidic composition as described above comprising about 10 to 100 g/l of zinc ion, 50 to 400 g/l phosphate ion, 0.005 to 15.0 g/l tungsten and as an accelerator about 10 to 400 g/l of an oxime, hydroxylamine sulfate, or mixtures thereof.

The present invention further provides a process for forming a zinc phosphate, tungsten-containing coating on a metal substrate comprising contacting the metal with an aqueous acidic zinc phosphate, tungsten-containing coating composition as described above.

The present invention also provides for a metal substrate containing from 0.5 to 6.0 grams per square meter ($g/m^2$) of a zinc phosphate, tungsten-containing coating applied by the process described above.

DETAILED DESCRIPTION

The zinc ion content of the aqueous acidic, tungsten-containing compositions is preferably between about 0.5 to 1.5 g/l and is more preferably about 0.8 to 1.2 g/l, while the phosphate content is preferably between about 4.0 to 16.0 g/l, and more preferably about 4.0 to 7.0 g/l. The source of the zinc ion may be conventional zinc ion sources, such as zinc nitrate, zinc oxide, zinc carbonate, zinc metal, and the like, while the source of phosphate ion may be phosphoric acid, monosodium phosphate, disodium phosphate, and the like. The aqueous acidic zinc phosphate, tungsten-coating composition typically has a pH of between about 2.5 to 5.5 and preferably between about 3.0 to 3.5. The tungsten content of the aqueous acidic, tungsten-containing composition is preferably between about 0.01 to 0.15 g/l and is more preferably between about 0.03 to 0.05 g/l. The source of the tungsten may be silicotungstic acid or a silicotungstate such as an alkali metal salt of silicotungstic acid, an alkaline earth metal salt of silicotungstic acid, an ammonium salt of silicotungstic acid, and the like.

The accelerator content of the aqueous acidic, tungsten-containing compositions is an amount sufficient to accelerate the formation of the zinc phosphate, tungsten-containing coating and is usually added in an amount of about 0.5 to 20 g/l, preferably between about 1 to 10 g/l, and most preferably in an amount between about 1 to 5 g/l. The oxime is one which is soluble in aqueous acidic tungsten-containing compositions and is stable in such solutions, that is it will not prematurely decompose and lose its activity, at a pH of between 2.5 and 5.5, for a sufficient time to accelerate the formation of the zinc phosphate, tungsten-containing coating on a metal substance. Especially useful oximes are acetaldehyde oxime which is preferred and acetoxime; or hydroxylamine sulfate can be used, either alone or in combination with the oxime.

In addition to the zinc ion, the phosphate ion, tungsten and accelerator, the aqueous acidic, tungsten-containing phosphate compositions may contain fluoride ion, nitrate ion, and various metal ions, such as calcium ion, magnesium ion, manganese ion, iron ion, and the like. When present, fluoride ion should be in an amount of about 0.1 to 5.0 g/l and preferably between about 0.25 to 1.0 g/l; nitrate ion in an amount of about 1 to 10 g/l, preferably between about 1 to 5 g/l; calcium ion in an amount of about 0 to 4.0 g/l, preferably between about 0.2 to 2.5 g/l; manganese ion in an amount of 0 to about 2.5 g/l, preferably about 0.2 to 1.5 g/l, and more preferably between about 0.5 to 0.9 g/l; iron ion in an amount of about 0 to 0.5 g/l, preferably between about 0.005 to 0.3 g/l.

It has been found especially useful to provide fluoride ion in the acidic aqueous, tungsten-containing zinc phosphate coating compositions, preferably in an amount of about 0.25 to 1.0 g/l, in combination with the oxime, preferably acetaldehyde oxime. The source of the fluoride ion may be free fluoride such as derived from ammonium bifluoride, potassium bifluoride, sodium bifluoride, hydrogen fluoride, sodium fluoride, potassium fluoride, or complex fluoride ions such as fluoroborate ion or a fluorosilicate ion. Mixtures of free and complex fluorides may also be used. Fluoride ion in combination with the oxime typically lowers the amount of oxime required to achieve equivalent performance to nitrite accelerated compositions.

In addition to the oxime or hydroxylamine sulfate accelerator, accelerators other than nitrites may be used with the oxime or hydroxylamine sulfate accelerator. Typical accelerators are those known in the art, such as aromatic nitro-compounds, including sodium nitrobenzene sulfonates, particularly sodium m-nitrobenzene sulfonate, chlorate ion and hydrogen peroxide. These additional accelerators, when used, are present in amounts of from about 0.005 to 5.0 g/l.

An especially useful aqueous acidic, tungsten-containing zinc phosphate composition according to the present invention is one having a pH of between about 3.0 to 3.5 containing about 0.8 to 1.2 g/l of zinc ion, about 4.9 to 5.5 g/l of phosphate ion, about 0.03 to 0.05 g/l of tungsten, about 0.5 to 0.9 g/l of manganese ion, about 1.0 to 5.0 g/l of nitrate ion, about 0.25 to 1.0 g/l of fluoride ion, and about 0.5–1.5 g/l of acetaldehyde oxime or hydroxylamine sulfate or mixtures thereof.

The aqueous acidic, tungsten-containing composition of the present invention can be prepared fresh with the above mentioned ingredients in the concentrations specified or can be prepared from aqueous concentrates in which the concentration of the various ingredients is considerably higher. Concentrates are generally prepared beforehand and shipped to the application site where they are diluted with aqueous medium such as water or are diluted by feeding them into a zinc phosphating composition which has been in use for some time. Concentrates are a practical way of replacing the active ingredients. In addition the oxime accelerators of the present invention are stable in the concentrates, that is they do not prematurely decompose, which is an advantage over nitrite accelerators which are unstable in acidic concentrates. Typical concentrates would usually contain from about 10 to 100 g/l zinc ion, preferably 10 to 30 g/l zinc ion, and more preferably about 16 to 20 g/l of zinc ion and about 50 to 400 g/l phosphate ion, preferably 80 to 400 g/l of phosphate ion, and more preferably about 90 to 120 g/l of phosphate ion, from about 0.005 to 15.0 g/l tungsten, preferably 0.1 to 1.0 g/l tungsten, and more preferably about 0.5 to 0.8 g/l tungsten and as an accelerator about 10 to 400 g/l, preferably about 10 to 40 g/l of an oxime or hydroxylamine sulfate or mixture thereof. Optional ingredients, such as fluoride, ion are usually present in the concentrates in amounts of about 2 to 50 g/l, preferably about 5 to 20 g/l. Other optional ingredients include manganese ion present in amounts of about 4.0 to 40.0 g/l, preferably 4.0 to 12.0 g/l; nitrate ion present in amounts of about 10 to 200 g/l, preferably 15 to 100 g/l. Other metal ions, such as calcium and magnesium, can be present. Additional accelerators, such as hydrogen peroxide, sodium nitrobenzene-sulfonate and chlorate ion can also be present.

The aqueous acidic, tungsten-containing composition of the present invention is usable to coat metal substrates composed of various metal compositions, such as the ferrous metals, steel, galvanized steel, or steel alloys, zinc or zinc alloys, and other metal compositions such as aluminum or aluminum alloys. Typically, a substrate such as an automobile body will have more than one metal or alloy associated with it and the zinc phosphate, tungsten-containing coating compositions of the present invention are particularly useful in coating such substrates.

The aqueous acidic, tungsten-containing composition of the present invention may be applied to a metal substrate by known application techniques, such as dipping, spraying, intermittent spraying, dipping followed by spraying or spraying followed by dipping. Typically, the aqueous acidic tungsten-containing composition is applied to the metal substrate at temperatures of about 90° F. to 160° F. (32° C. to 71° C.), and preferably at temperatures of between about 115° F. to 130° F. (46° C. to 54° C.). The contact time for the application of the zinc phosphate, tungsten-containing coating composition is generally between about 0.5 to 5 minutes when dipping the metal substrate in the aqueous acidic composition and between about 0.5 to 3.0 minutes when the aqueous acidic composition is sprayed onto the metal substrate.

The resulting coating on the substrate is continuous and uniform with a crystalline structure which can be platelet, columnar or nodular. The coating weight is about 0.5 to 6.0 grams per square meter ($g/m^2$).

It will also be appreciated that certain other steps may be done both prior to and after the application of the coating by the processes of the present invention. For example, the substrate being coated is preferably first cleaned to remove grease, dirt, or other extraneous matter. This is usually done by employing conventional cleaning procedures and materials. These would include, for example, mild or strong alkali cleaners, acidic cleaners, and the like. Such cleaners are generally followed and/or preceded by a water rinse.

It is preferred to employ a conditioning step following or as part of the cleaning step, such as disclosed in U.S. Pat. Nos. 2,874,081; and 2,884,351. The conditioning step involves application of a condensed titanium phosphate solution to the metal substrate. The conditioning step provides nucleation sites on the surface of the metal substrate resulting in the formation of a densely packed crystalline coating which enhances performance.

After the zinc phosphate, tungsten-containing conversion coating is formed, it is advantageous to subject the coating to a post-treatment rinse to seal the coating and improve performance. The rinse composition may contain chromium (trivalent and/or hexavalent) or may be chromium-free.

The invention will be further understood from the following non-limiting examples, which are provided to illustrate the invention and in which all parts indicated are parts by weight unless otherwise specified.

EXAMPLE I

The following treatment process was used in the following examples:

(a) the panels were first cleaned with a pre-wipe of CHEMKLEEN 260;

(b) degreasing—the panels were then degreased by use of an alkaline degreasing agent (1) CHEMKLEEN 177N (1 ounce/gallon) which was sprayed onto the metal substrate at 43° C. for one minute followed by immersion into the same agent at 43° C. for two minutes;

(c) warm water rinsing—the panels were then immersed into a warm water rinse for 60 seconds (at 43° C.);

(d) conditioning—the test panels were then immersed into a surface conditioner ("PPG Rinse Conditioner" available from PPG Industries, Inc.) at 1.5 grams/liter at 38° C. for one minute;

(e) phosphating—in which the test panels were dipped into the acidic aqueous composition at 52° C. for two minutes;

(f) rinsing—the coated panels were rinsed by spraying with water at room temperature for 30 seconds;

(g) post-treatment rinse—the panels were then treated with a post-treatment rinse by immersion into one of the following rinse compositions for 30 seconds at room temperature: The post-treatment rinse compositions in the following tables are a, b, c, or d, as follows:

(a) Chemseal 20, a hexavalent/trivalent chrome mix rinse;

(b) Chemseal 18, a trivalent chrome rinse; and (c) Chemseal 59, a non-chrome rinse;

(d) Chemseal 77, a non-chrome rinse;

(h) DI—water rinse—the panels were sprayed for 15 seconds, and (i) the panels were dried by using a hot-air gun.

The coating compositions used in Example I were as follows:

I: A zinc nickel—manganese phosphate composition containing a nitrite accelerator sold by PPG Industries, Inc. under the tradename Chemfos 700.

II: Coating compositions of the present invention containing:

Zn: 0.9 to 1.2 g/l (grams/liter)

$PO_4$: 4.9 to 5.5 g/l

W: 0.03 to 0.05 g/l (as tungsten)

Mn: 0.5–0.65 g/l $NO_3$: 2.4–2.7 g/l

F: 0.54–0.62 g/l $SO_4$: 0.60–0.63 g/l

Fe: 0.01 g/l

Acetaldehyde oxime (AAO): 1 g/l (where used)

Hydroxylamine sulfate (HAS): 1 g/l (where used) (0.4 g/l as hydroxylamine)

Total Acid (TA): 9.0–10.0 pts

Free Acid (FA): 0.7–0.8 pts

Temperature=49° C.–52° C.

Note: Free Acid and Total Acid are measured in units of Points. Points are equal to milliequivalents per gram (meq/g) multiplied by 100. The milliequivalents of acidity in the sample are equal to the milliequivalents of base, typically potassium hydroxide, required to neutralize 1 gram of sample as determined by potentiometric titration.

The resultant coating weights and crystal size in the following Tables I–XXI were:

| | Composition I | | Composition II | |
|---|---|---|---|---|
| Substrate | Coating Weight ($g/m^2$) | Crystal Size microns) | Coating Weight ($g/m^2$) | Crystal Size (microns) |
| Cold rolled steel | 2.18 | 2–4 | 2.93 | 2–6 |
| Electro–galvanized Steel | 2.41 | 2–4 | 2.71 | 3–6 |
| Hot Dipped Galvanized Steel | 1.99 | 2–5 | 2.32 | 3–8 |
| Electro–galvanized Fe/Zn | 2.41 | 2–5 | 2.49 | 3–8 |
| Hot Dipped Electro–galvanized Fe/Zn | 3.39 | 2–8 | 3.88 | 3–10 |
| Ni/Zn Alloy | 2.13 | 2–6 | 2.35 | 4–8 |
| 6111 Al Substrate | 2.06 | 2–6 | 2.83 | 5–12 |

Cyclic Corrosion—GM 9540P, Cycle B.

After preparation, the samples are treated at 25° C. and 50% RH environment for 8 hours, including 4 sprays at 90 minutes intervals with a solution containing 0.9% NaCl, 0.1% $CaCl_2$, and 0.25% $NaHCO_3$ in deionized water. The samples are then subjected to an 8 hour fog, 100% RH at 40° C., followed by 8 hours at 60° C. and less than 20% RH. The entire treatment is repeated for the desired number of cycles, usually 40 cycles. The average total creep in mm (AVG.) and maximum creep on the left side of a scribe plus the maximum creep on the right hand side of the scribe (MAX.) were determined. GM 9540P—Cycle B corrosion test coating comparison, in mm, are given in Tables I–XIV.

Chrysler Chipping Scab testing results, (test as described in U.S. Pat. No. 5,360,492), average total creep, in mm, and % chip are given in Tables XV–XXI.

The paint systems used to coat the test panels were:

(1) PPG ED-5000 (lead containing electrocoat primer)/PPG Basecoat BWB 9753/PPG Clearcoat NCT 2AV+NCT 2 BR;

(2) PPG Enviroprime (unleaded electrocoat primer)/PPG Basecoat BWB 9753/PPG Clearcoat NCT 2AV+NCT 2 BR.

TABLE I

Test Results on Cold Rolled Steel Substrate using a leaded E-coat/Basecoat/Clearcoat paint system.

| | I | |
|---|---|---|
| | AVG. | MAX. |
| 1[a] | 2.9 | 4.0 |
| 2[a] | 2.9 | 4.0 |
| 3[a] | 3.5 | 5.0 |
| 4[b] | 3.4 | 4.5 |

TABLE I-continued

Test Results on Cold Rolled Steel Substrate using a leaded E-coat/Basecoat/Clearcoat paint system.

| | | |
|---|---|---|
| 5[b] | 2.0 | 4.0 |
| 6[b] | 3.4 | 6.0 |
| 7[c] | 4.1 | 6.0 |
| 8[c] | 3.7 | 6.0 |
| 9[c] | 3.6 | 5.0 |
| | II | |
| | AVG. | MAX. |
| 1[a] | 3.0 | 4.5 |
| 2[a] | 3.0 | 4.0 |
| 3[a] | 4.0 | 5.0 |
| 4[b] | 4.3 | 6.0 |
| 5[b] | 4.2 | 5.5 |
| 6[b] | 3.4 | 5.0 |
| 7[c] | 4.1 | 6.0 |
| 8[c] | 3.4 | 5.0 |
| 9[c] | 3.5 | 5.5 |
| 10[c] | 3.6 | 5.5 |
| 11[c] | 5.2 | 6.5 |

TABLE II

Test Results on Electrogalvanized Steel Substrate using a leaded E-coat/Basecoat/Clearcoat paint system.

| | | |
|---|---|---|
| | I | |
| | AVG. | MAX. |
| 10[a] | 1.2 | 2.0 |
| 11[a] | 1.2 | 2.0 |
| 12[a] | 1.4 | 2.5 |
| 13[b] | 0.5 | 1.0 |
| 14[b] | 1.1 | 2.0 |
| 15[b] | 0.9 | 1.5 |
| 16[c] | 1.1 | 3.0 |
| 17[c] | 1.3 | 2.0 |
| 18[c] | 0.7 | 1.0 |
| | II | |
| | AVG. | MAX. |
| 12[a] | 0.5 | 1.5 |
| 13[a] | 0.6 | 1.0 |
| 14[a] | 0.6 | 1.0 |
| 15[b] | 0.5 | 1.5 |
| 16[b] | 0.5 | 1.0 |
| 17[b] | 0.5 | 1.0 |
| 18[c] | 0.5 | 1.0 |
| 19[c] | 0.5 | 1.0 |
| 20[c] | 0.5 | 1.0 |

TABLE III

Test Results on Hot dipped Galvanized Steel Substrate using a leaded E-coat/Basecoat/Clearcoat paint system.

| | | |
|---|---|---|
| | I | |
| | AVG. | MAX. |
| 19[a] | 0.5 | 0.5 |
| 20[a] | 0.5 | 0.5 |
| 21[a] | 0.5 | 0.5 |
| 22[b] | 0.5 | 0.5 |
| 23[b] | 0.5 | 0.5 |
| 24[b] | 0.5 | 0.5 |
| 25[c] | 0.5 | 0.5 |

TABLE III-continued

Test Results on Hot dipped Galvanized Steel Substrate using a leaded E-coat/Basecoat/Clearcoat paint system.

| | | |
|---|---|---|
| 26[c] | 0.5 | 0.5 |
| 27[c] | 1.4 | 2.5 |
| | II | |
| | AVG. | MAX. |
| 21[a] | 0.5 | 1.5 |
| 22[a] | 0.5 | 1.5 |
| 23[a] | 0.6 | 1.4 |
| 24[b] | 0.5 | 2.0 |
| 25[b] | 0.5 | 1.0 |
| 26[b] | 0.5 | 1.0 |
| 27[c] | 1.1 | 3.0 |
| 28[c] | 0.5 | 2.0 |
| 29[c] | 0.5 | 1.0 |

TABLE IV

Test Results on Electrogalvanized Fe/Zn alloy substrate using a leaded E-coat/Basecoat/Clearcoat paint system.

| | | |
|---|---|---|
| | I | |
| | AVG. | MAX. |
| 28[a] | 0.6 | 1.0 |
| 29[a] | 0.7 | 2.0 |
| 30[a] | 0.5 | 0.5 |
| 31[b] | 0.5 | 1.0 |
| 32[b] | 0.6 | 2.0 |
| 33[b] | 0.5 | 1.0 |
| 34[c] | 0.5 | 0.5 |
| 35[c] | 0.5 | 1.0 |
| 36[c] | 0.5 | 1.5 |
| | II | |
| | AVG. | MAX. |
| 30[a] | 0.5 | 1.0 |
| 31[a] | 0.5 | 1.0 |
| 32[a] | 0.5 | 0.5 |
| 33[b] | 0.5 | 0.5 |
| 34[b] | 0.5 | 0. 5 |
| 35[b] | 0.5 | 1.0 |
| 36[c] | 0.5 | 1.0 |
| 37[c] | 0.5 | 0.5 |
| 38[c] | 0.5 | 1.5 |

TABLE V

Test results on Hot-Dipped Fe/Zn alloy substrate using a leaded E-coat/Basecoat/Clearcoat paint system.

| | | |
|---|---|---|
| | I | |
| | AVG. | MAX. |
| 37[a] | 0.5 | 1.0 |
| 38[a] | 0.5 | 1.0 |
| 39[a] | 0.5 | 1.0 |
| 40[b] | 0.5 | 1.0 |
| 41[b] | 0.5 | 1.0 |
| 42[b] | 0.6 | 1.0 |
| 43[c] | 0.5 | 0.5 |
| 44[c] | 0.5 | 1.0 |
| 45[c] | 0.5 | 0.5 |

TABLE V-continued

Test results on Hot-Dipped Fe/Zn alloy substrate using a leaded E-coat/Basecoat/Clearcoat paint system.

| | II | |
|---|---|---|
| | AVG. | MAX. |
| 39[a] | 0.5 | 0.5 |
| 40[a] | 0.5 | 0.5 |
| 41[a] | 0.5 | 0.5 |
| 42[b] | 0.5 | 0.5 |
| 43[b] | 0.5 | 0.5 |
| 44[b] | 0.5 | 1.0 |
| 45[c] | 0.9 | 1.5 |
| 46[c] | 1.0 | 1.5 |
| 47[c] | 0.6 | 1.5 |

TABLE VI

Test Results on a Ni/Zn alloy substrate using a leaded E-coat/Basecoat/Clearcoat paint system.

| | I | |
|---|---|---|
| | AVG. | MAX. |
| 46[a] | 3.6 | 10.0 |
| 47[a] | 1.6 | 7.0 |
| 48[a] | 2.2 | 8.0 |
| 49[b] | 1.0 | 4.5 |
| 50[b] | 2.1 | 10.0 |
| 51[b] | 2.6 | 8.5 |
| 52[c] | 0.5 | 2.5 |
| 53[c] | 2.3 | 9.5 |
| 54[c] | 3.0 | 6.5 |
| | II | |
| | AVG. | MAX. |
| 48[a] | 3.3 | 9.0 |
| 49[a] | 2.0 | 7.0 |
| 50[a] | 2.2 | 7.5 |
| 51[b] | 1.1 | 3.5 |
| 52[b] | 2.7 | 7.5 |
| 53[b] | 1.1 | 5.5 |
| 54[c] | 1.9 | 5.0 |
| 55[c] | 0.9 | 2.5 |
| 56[c] | 0.5 | 0.5 |

TABLE VII

Test Results on a 6111 Aluminum Substrate using a leaded E-coat/Basecoat/Clearcoat paint system.

| | I | |
|---|---|---|
| | AVG. | MAX. |
| 55[a] | 0.5 | 0.5 |
| 56[a] | 0.5 | 0.5 |
| 57[a] | 0.5 | 1.0 |
| 58[b] | 0.5 | 1.0 |
| 59[b] | 0.5 | 1.0 |
| 60[b] | 0.5 | 1.0 |
| 61[c] | 0.6 | 1.0 |
| 62[c] | 0.5 | 1.5 |
| 63[c] | 0.5 | 0.5 |

TABLE VII-continued

Test Results on a 6111 Aluminum Substrate using a leaded E-coat/Basecoat/Clearcoat paint system.

| | II | |
|---|---|---|
| | AVG. | MAX. |
| 57[a] | 0.5 | 0.5 |
| 58[a] | 0.5 | 0.5 |
| 59[a] | 0.5 | 0.5 |
| 60[b] | 0.5 | 1.0 |
| 61[b] | 0.5 | 0.5 |
| 62[b] | 0.5 | 0.5 |
| 63[c] | 0.5 | 0.5 |
| 64[c] | 0.5 | 0.5 |
| 65[c] | 0.5 | 0.5 |

TABLE VIII

Test Results on Cold Rolled Steel Substrate using an unleaded E-coat/Basecoat/Clearcoat paint system.

| | I | |
|---|---|---|
| | AVG. | MAX. |
| 64[d] | 2.9 | 3.5 |
| 65[d] | 2.5 | 4.5 |
| 66[d] | 2.5 | 4.5 |
| 67[b] | 2.9 | 4.0 |
| 68[b] | 3.5 | 5.0 |
| 69[b] | 2.8 | 4.0 |
| 70[c] | 3.4 | 4.5 |
| 71[c] | 2.9 | 4.0 |
| 72[c] | 3.1 | 4.5 |
| | II | |
| | AVG. | MAX. |
| 66[d] | 4.4 | 5.5 |
| 67[d] | 3.8 | 6.0 |
| 68[d] | 4.3 | 6.0 |
| 69[b] | 4.3 | 6.0 |
| 70[b] | 4.6 | 5.5 |
| 71[b] | 4.5 | 6.0 |
| 72[c] | 4.0 | 5.0 |

TABLE IX

Test Results on Electrogalvanized Steel Substrate using an unleaded E-coat/Basecoat/Clearcoat paint system.

| | I | |
|---|---|---|
| | AVG. | MAX. |
| 73[d] | 1.0 | 1.0 |
| 74[d] | 0.6 | 1.0 |
| 75[d] | 0.6 | 1.0 |
| 76[b] | 0.8 | 1.0 |
| 77[b] | 0.8 | 1.5 |
| 78[b] | 0.5 | 0.5 |
| 79[c] | 0.5 | 0.5 |
| 80[c] | 0.6 | 1.0 |
| 81[c] | 0.6 | 1.0 |
| | II | |
| | AVG. | MAX. |
| 73[d] | 0.5 | 1.5 |
| 74[d] | 0.6 | 1.0 |
| 75[d] | 1.0 | 1.5 |

TABLE IX-continued

Test Results on Electrogalvanized Steel Substrate using an unleaded E-coat/Basecoat/Clearcoat paint system.

| | | |
|---|---|---|
| 76[b] | 0.7 | 2.0 |
| 77[b] | 0.8 | 2.0 |
| 78[b] | 1.5 | 3.0 |
| 79[c] | 0.6 | 2.0 |
| 80[c] | 0.6 | 1.5 |
| 81[c] | 0.6 | 1.5 |

TABLE X

Test Results on a Hot Dipped Galvanized Steel Substrate using an unleaded E-coat/Basecoat/Clearcoat paint system.

| | I | |
|---|---|---|
| | AVG. | MAX. |
| 82[d] | 0.6 | 1.0 |
| 83[d] | 0.9 | 1.0 |
| 84[d] | 0.5 | 0.5 |
| 85[b] | 0.5 | 0.5 |
| 86[b] | 0.7 | 1.0 |
| 87[b] | 0.7 | 1.0 |
| 88[c] | 0.5 | 0.5 |
| 89[c] | 0.5 | 0.5 |
| 90[c] | 0.5 | 0.5 |
| | II | |
| | AVG. | MAX. |
| 82[d] | 0.6 | 2.0 |
| 83[d] | 0.5 | 1.0 |
| 84[d] | 0.7 | 2.0 |
| 85[b] | 0.7 | 2.0 |
| 86[b] | 1.2 | 3.0 |
| 87[b] | 0.8 | 1.5 |
| 88[c] | 0.5 | 1.5 |
| 89[c] | 1.2 | 2.5 |
| 90[c] | 0.8 | 2.0 |

TABLE XI

Test Results on an Electrogalvanized Fe/Zn alloy substrate using an unleaded E-coat/Basecoat/Clearcoat paint system.

| | I | |
|---|---|---|
| | AVG. | MAX. |
| 91[d] | 0.5 | 1.5 |
| 92[d] | 0.5 | 1.0 |
| 93[d] | 0.5 | 1.0 |
| 94[b] | 0.5 | 1.0 |
| 95[b] | 0.5 | 1.0 |
| 96[b] | 0.5 | 0.5 |
| 97[c] | 0.6 | 1.0 |
| 98[c] | 0.5 | 1.0 |
| 99[c] | 0.5 | 1.0 |
| | II | |
| | AVG. | MAX. |
| 91[d] | 0.8 | 1.0 |
| 92[d] | 0.9 | 1.5 |
| 93[d] | 0.7 | 1.5 |
| 94[b] | 0.7 | 1.5 |
| 95[b] | 0.7 | 2.0 |
| 96[b] | 1.1 | 2.0 |

TABLE XI-continued

Test Results on an Electrogalvanized Fe/Zn alloy substrate using an unleaded E-coat/Basecoat/Clearcoat paint system.

| | | |
|---|---|---|
| 97[b] | 0.6 | 1.0 |
| 98[b] | 0.7 | 1.5 |
| 99[b] | 0.5 | 2.0 |

TABLE XII

Test Results on a Hot-Dipped Fe/Zn alloy substrate using an unleaded E-coat/Basecoat/Clearcoat paint system.

| | I | |
|---|---|---|
| | AVG. | MAX. |
| 100[d] | 0.5 | 0.5 |
| 101[d] | 0.5 | 0.5 |
| 102[d] | 0.6 | 1.0 |
| 103[b] | 0.5 | 1.0 |
| 104[b] | 0.5 | 0.5 |
| 105[b] | 0.5 | 0.5 |
| 106[c] | 0.6 | 1.0 |
| 107[c] | 0.6 | 1.0 |
| 108[c] | 0.7 | 1.5 |
| | II | |
| | AVG. | MAX. |
| 100[d] | 0.5 | 1.5 |
| 101[d] | 0.5 | 2.0 |
| 102[d] | 0.6 | 1.0 |
| 103[b] | 0.7 | 1.0 |
| 104[b] | 1.3 | 2.0 |
| 105[b] | 0.7 | 1.0 |
| 106[c] | 0.5 | 1.0 |
| 107[c] | 0.7 | 1.5 |
| 108[c] | 0.8 | 1.0 |

TABLE XIII

Test Results on a Ni/Zn alloy substrate using an unleaded E-coat/Basecoat/Clearcoat paint system.

| | I | |
|---|---|---|
| | AVG. | MAX. |
| 109[d] | 1.7 | 8.0 |
| 110[d] | 2.0 | 7.0 |
| 111[d] | 2.9 | 8.0 |
| 112[b] | 2.2 | 8.5 |
| 113[b] | 2.9 | 7.5 |
| 114[b] | 4.2 | 11.0 |
| 115[c] | 1.8 | 5.5 |
| 116[c] | 3.6 | 9.0 |
| 117[c] | 0.5 | 0.5 |
| | II | |
| | AVG. | MAX. |
| 109[d] | 5.4 | 9.0 |
| 110[d] | 0.8 | 8.0 |
| 111[d] | 1.8 | 9.0 |
| 112[b] | 2.6 | 9.5 |
| 113[b] | 2.6 | 3.0 |
| 114[b] | 3.7 | 8.0 |
| 115[c] | 3.5 | 10.0 |
| 116[c] | 1.3 | 4.0 |
| 117[c] | 2.8 | 9.0 |

TABLE XIV

Test Results on a 6111 Aluminum Substrate using an unleaded E-coat/Basecoat/Clearcoat paint system.

| | I | |
|---|---|---|
| | AVG. | MAX. |
| 118[d] | 0.5 | 1.5 |
| 119[d] | 0.5 | 0.5 |
| 120[d] | 0.5 | 1.0 |
| 121[b] | 0.5 | 2.0 |
| 122[b] | 0.5 | 1.5 |
| 123[b] | 0.5 | 0.5 |
| 124[c] | 0.5 | 0.5 |
| 125[c] | 0.5 | 1.0 |
| 126[c] | 0.6 | 1.5 |
| | II | |
| | AVG. | MAX. |
| 118[d] | 0.5 | 0.5 |
| 119[d] | 0.5 | 1.0 |
| 120[d] | 0.5 | 0.5 |
| 121[b] | 0.5 | 0.5 |
| 122[b] | 0.5 | 0.5 |
| 123[b] | 0.5 | 0.5 |
| 124[c] | 0.5 | 0.5 |
| 125[c] | 0.5 | 1.0 |
| 126[c] | 0.5 | 0.5 |

A comparison of scab and chip values on various coated substrates using the present composition as compared to Composition I are given in Tables XV–XXI.

TABLE XV

Test Results on Cold Rolled Steel Substrate using a leaded E-coat/Basecoat/Clearcoat paint system.

| | I | |
|---|---|---|
| | Scab mm. | Chip % |
| 127[a] | 0 | 3.0 |
| 128[a] | 0 | 1.8 |
| 129[a] | 1 | 1.8 |
| 130[b] | 0 | 2.5 |
| 131[b] | 1 | 2.8 |
| 132[b] | 1 | 2.5 |
| 133[c] | 0 | 2.8 |
| 134[c] | 0 | 2.8 |
| 135[c] | 0 | 3.8 |
| | II | |
| | Scab mm. | Chip % |
| 127[a] | 0 | 1.8 |
| 128[a] | 1 | 1.8 |
| 129[a] | 1 | 1.5 |
| 130[b] | 1 | 1.5 |
| 131[b] | 0 | 1.8 |
| 132[b] | 0 | 1.8 |
| 133[c] | 1 | 1.8 |
| 134[c] | 2 | 1.0 |
| 135[c] | 1 | 1.8 |

TABLE XVI

Test Results on Electrogalvanized Steel Substrate using a leaded E-coat/Basecoat/Clearcoat paint system.

| | I | |
|---|---|---|
| | Scab mm. | Chip % |
| 136[a] | 0 | <1 |
| 137[a] | 1 | 1.0 |
| 138[a] | 0 | <1 |
| 139[b] | 1 | 2.0 |
| 140[b] | 0 | 1.8 |
| 141[b] | 0 | <1 |
| 142[c] | 1 | 2.0 |
| 143[c] | 0 | 2.5 |
| 144[c] | 0 | 1.8 |
| | II | |
| | Scab mm. | Chip % |
| 136[a] | 2 | 1.8 |
| 137[a] | 2 | 1.8 |
| 138[a] | 2 | 1.8 |
| 139[b] | 2 | 3.0 |
| 140[b] | 2 | 2.5 |
| 141[b] | 2 | 1.5 |
| 142[c] | 1 | 7.5 |
| 143[c] | 3 | 3.5 |
| 144[c] | 2 | 3.5 |

TABLE XVII

Test Results on a Hot Dipped Galvanized Steel Substrate using a leaded E-coat/Basecoat/Clearcoat paint system.

| | I | |
|---|---|---|
| | Scab mm. | Chip % |
| 145[a] | 0 | 1.0 |
| 146[a] | 1 | 1.0 |
| 147[a] | 1 | 1.8 |
| 148[b] | 0 | 1.8 |
| 149[b] | 0 | 1.0 |
| 150[b] | 0 | <1 |
| 151[c] | 1 | 2.8 |
| 152[c] | 1 | 2.8 |
| 153[c] | 2 | 1.8 |
| | II | |
| | Scab mm. | Chip % |
| 145[a] | 2 | 4.5 |
| 146[a] | 2 | 1.8 |
| 147[a] | 2 | 3.5 |
| 148[b] | 0 | 3.5 |
| 149[b] | 2 | 3.5 |
| 150[b] | 1 | 3.0 |
| 151[c] | 3 | 5.9 |
| 152[c] | 3 | 2.0 |
| 153[c] | 2 | 2.8 |

TABLE XVIII

Test Results on an electrogalvanized Fe/Zn alloy Substrate using a leaded E-coat/Basecoat/Clearcoat paint system.

| | I | |
|---|---|---|
| | Scab mm. | Chip % |
| 154[a] | 0 | 1.5 |
| 155[a] | 0 | 1.0 |
| 156[a] | 0 | 1.0 |
| 157[b] | 0 | 2.5 |
| 158[b] | 0 | 2.8 |
| 159[b] | 0 | 1.8 |
| 160[c] | 0 | 2.0 |
| 161[c] | 0 | 2.8 |
| 162[c] | 1 | 2.0 |
| | II | |
| | Scab mm. | Chip % |
| 154[a] | 0 | 1.0 |
| 155[a] | 1 | 1.0 |
| 156[a] | 0 | 1.8 |
| 157[b] | 1 | 1. 0 |
| 158[b] | 1 | 2.8 |
| 159[b] | 0 | 2.0 |
| 160[c] | 2 | 1.0 |
| 161[c] | 3 | 1.0 |
| 162[c] | 3 | 1.5 |

TABLE XIX

Test Results on a Hot-Dipped Fe/Zn Alloy using a leaded E-coat/Basecoat/Clearcoat paint system.

| | I | |
|---|---|---|
| | Scab mm. | Chip % |
| 163[a] | 0 | 1.0 |
| 164[a] | 0 | 1.0 |
| 165[a] | 0 | 1.8 |
| 166[b] | 0 | 1.8 |
| 167[b] | 0 | 2.8 |
| 168[b] | 0 | 2.5 |
| 169[c] | 1 | 2.8 |
| 170[c] | 0 | 2.8 |
| 171[c] | 0 | 3.0 |
| | II | |
| | Scab mm. | Chip % |
| 163[a] | 0 | 1.8 |
| 164[a] | 1 | 2.5 |
| 165[a] | 0 | 1.8 |
| 166[a] | 0 | 1.0 |
| 167[a] | 0 | 1.0 |
| 168[a] | 0 | 1.0 |
| 169[a] | 0 | 1.8 |
| 170[a] | 0 | 1.8 |
| 171[a] | 0 | 1.5 |

TABLE XX

Test Results on a Ni/Zn Alloy Substrate using a leaded E-coat/Basecoat/Clearcoat paint system.

| | I | |
|---|---|---|
| | Scab mm. | Chip % |
| 172[a] | 1 | 2.0 |
| 173[a] | 4 | 1.8 |
| 174[a] | 9 | 1.5 |
| 175[b] | 3 | 2.0 |
| 176[b] | 3 | 2.8 |
| 177[b] | 0 | 3.0 |
| 178[c] | 3 | 2.8 |
| 179[c] | 1 | 3.0 |
| 180[c] | 1 | 2.8 |
| | II | |
| | Scab mm. | Chip % |
| 172[c] | 1 | 2.0 |
| 173[c] | 2 | 2.0 |
| 174[c] | 2 | 1.8 |
| 175[c] | 0 | 2.0 |
| 176[c] | 0 | <1 |
| 177[c] | 0 | 1.0 |
| 178[c] | 0 | 3.0 |
| 179[c] | 5 | 2.8 |
| 180[c] | 1 | 3.0 |

TABLE XXI

Test Results on a 6111 Aluminum Substrate using a leaded E-coat/Basecoat/Clearcoat paint system.

| | I | |
|---|---|---|
| | Scab mm. | Chip % |
| 181[a] | 0 | <1 |
| 182[a] | 0 | <1 |
| 183[a] | 0 | <1 |
| 184[b] | 0 | <1 |
| 185[b] | 0 | <1 |
| 186[b] | 0 | <1 |
| 187[c] | 0 | <1 |
| 188[c] | 0 | <1 |
| 189[c] | 0 | <1 |
| | II | |
| | Scab mm. | Chip % |
| 181[a] | 0 | <1 |
| 182[a] | 0 | <1 |
| 183[a] | 0 | <1 |
| 184[b] | 0 | <1 |
| 185[b] | 0 | <1 |
| 186[b] | 0 | <1 |
| 187[c] | 0 | <1 |
| 188[c] | 0 | <1 |
| 189[c] | 0 | <1 |

The performance of the CF700 treated panels and those treated with the composition of the present invention were comparable regardless of the type of phosphate treatment used or the post-treatment used. Both compositions performed well in the testing regardless of which post-rinse was used (chrome or non-chrome) as the sealing rinse.

EXAMPLE II

A series of tests were run using a coating composition of the present invention with the amount of tungsten varied and with different accelerators used; hydroxylamine sulfate (HAS), acetaldehyde oxime (AAO). The treatment process was the same as used in Example I except that no post treatment rinse was used but the panels merely rinsed with a deionized (DI) water rinse. Tables XXII–XXIV list the coating weights (ct. wt.) in grams/meter$^2$ (g/m$^2$) and crystal sizes in microns using various metal substrates: cold rolled steel (CRS), electrogalvanized steel (EG), electrogalvanized Fe/Zn alloy (Fe/Zn), and a 6111 aluminum substrate (6111 Al).

TABLE XXII (AAO accelerator)

| | | | | | | |
|---|---|---|---|---|---|---|
| Theoretical W (g/l) | 0.0 | 0.005 | 0.01 | 0.1 | 0.5 | 1.0 |
| Zn (g/l) | 1.03 | 0.99 | 0.95 | 0.98 | 0.95 | 0.94 |
| Mn (g/l) | 0.56 | 0.55 | 0.53 | 0.53 | 0.53 | 0.53 |
| W (g/l) | 0.0 | 0.0066 | 0.0096 | 0.084 | 0.43 | 0.89 |
| $PO_4$ (g/l) | 5.52 | 5.37 | 5.26 | 5.22 | 5.16 | 5.13 |
| $NO_3$ (g/l) | 2.03 | 2.01 | 1.98 | 1.95 | 1.92 | 1.96 |
| F (g/l) | 0.48 | 0.45 | 0.45 | 0.45 | 0.44 | 0.41 |
| $SO_4$ (g/l) | 0.04 | 0.04 | 0.04 | 0.0 | 0.0 | 0.0 |
| AAO (g/l) | 10.0 | 10.0 | 10.0 | 10.0 | 10.0 | 10.0 |
| CRS crystal size (microns) | 5–10 | 5–10 | 5–10 | 5–10 | 5–15 | 5–15* |
| CRS ct. wt. (g/sq.m.) | 3.48 | 3.15 | 3.07 | 4.36 | 3.13 | 3.21 |
| EG crystal size (microns) | 2–8 | 2–10 | 3–15 | 2–6 | 2–6 | 2–10 |
| EG ct. wt. (g/sq.m.) | 3.11 | 3.00 | 2.87 | 2.54 | 2.48 | 2.79 |
| Fe/Zn crystal size (microns) | 2–8 | 2–5 | 3–10 | 2–12 | 2–10 | 2–10 |
| Fe/Zn ct. wt. (g/sq.m.) | 2.91 | 2.78 | 2.72 | 3.65 | 3.9 | 4.58 |
| 6111Al crystal size (microns) | 10–20 | 5–15 | 5–15 | 5–15 | 5–20** | ** |
| 6111Al ct. wt. (g/sq.m.) | 1.99 | 1.76 | 1.71 | 2.84 | 4.23 | 1.08 |

* = incomplete
** = dusty and incomplete

TABLE XXIII (HAS accelerator)

| | | | | | | |
|---|---|---|---|---|---|---|
| Theoretical W (g/l) | 0.0 | 0.005 | 0.01 | 0.1 | 0.5 | 1.0 |
| Zn (g/l) | 1.06 | 0.99 | 0.96 | 1.02 | 0.97 | 0.95 |
| Mn (g/l) | 0.55 | 0.55 | 0.53 | 0.55 | 0.53 | 0.53 |
| W (g/l) | 0.0 | 0.0043 | 0.0093 | 0.86 | 0.45 | 0.89 |
| $PO_4$ (g/l) | 5.69 | 5.3 | 5.53 | 5.31 | 5.13 | 5.08 |
| $NO_3$ (g/l) | 2.16 | 2.08 | 2.13 | 2.0 | 1.93 | 1.94 |
| F (g/l) | 0.49 | 0.47 | 0.47 | 0.49 | 0.5 | 0.49 |
| $SO_4$ (g/l) | 0.53 | 0.46 | 0.49 | 0.48 | 0.46 | 0.46 |
| Hydroxyl Amine (g/l) | 0.4 | 0.4 | 0.4 | 0.4 | 0.4 | 0.4 |
| CRS crystal size (microns) | 2–10 | 2–8 | 2–8 | 2–8 | 2–5 | 3–15 |
| CRS ct. wt. (g/sq.m.) | 2.92 | 2.42 | 2.22 | 3.62 | 4.07 | 4.27 |
| EG crystal size (microns) | 3–10 | 5–15 | 6–20 | 2–8 | 2–8 | 2–5 |
| EG ct. wt. (g/sq.m.) | 3.01 | 2.9 | 2.86 | 2.49 | 2.46 | 3.1 |
| Fe/Zn crystal size (microns) | 3–10 | 5–10 | 3–10 | 3–6 | 3–6 | 3–6 |
| Fe/Zn ct. wt. (g/sq.m.) | 2.78 | 2.52 | 2.45 | 2.96 | 3.32 | 3.38 |
| 6111Al crystal size (microns) | 10–24 | 10–24 | 5–15 | 5–15 | ** | ** |
| 6111Al ct. wt. (g/sq.m.) | 1.88 | 1.61 | 1.6 | 3.08 | 2.15 | 0.85 |

** = dusty and incomplete

TABLE XXIV (HAS + AAO Accelerator)

| | | | | | | |
|---|---|---|---|---|---|---|
| Theoretical W (g/l) | 0.0 | 0.005 | 0.01 | 0.1 | 0.6 | 1.0 |
| Zn (g/l) | 1.08 | 1.02 | 1.02 | 1.16 | 1.16 | 1.09 |
| Mn (g/l) | 0.57 | 0.53 | 0.56 | 0.55 | 0.52 | 0.53 |
| W (g/l) | 0.002 | 0.005 | 0.0092 | 0.088 | 0.56 | 0.9 |
| $PO_4$ (g/l) | 5.29 | 5.73 | 5.3 | 5.32 | 5.04 | 5.06 |
| $NO_3$ (g/l) | 2.12 | 2.16 | 2.01 | 2.0 | 1.96 | 2.11 |
| F (g/l) | 0.5 | 0.48 | 0.48 | 0.52 | 0.47 | 0.5 |
| $SO_4$ (g/l) | 0.46 | 0.53 | 0.48 | 0.47 | 0.44 | 0.45 |
| Hydroxyl Amine (g/l) | 0.4 | 0.4 | 0.4 | 0.4 | 0.4 | 0.4 |
| AAO - (g/l) | 1.0 | 1.0 | 1.0 | 1.0 | 1.0 | 1.0 |
| CRS crystal size (microns) | 3–10 | 3–10 | 3–12 | 3–6 | 3–6 | 3–6 |
| CRS ct. wt. (g/sq.m.) | 3.2 | 2.65 | 2.3 | 3.52 | 4.28 | 4.2 |
| EG crystal size (microns) | 3–12 | 5–15 | 5–15 | 2–5 | 2–4 | 2–8 |
| EG ct. wt. (g/sq.m.) | 3 | 2.96 | 2.83 | 2.65 | 2.53 | 2.76 |
| Fe/Zn crystal size (microns) | 3–10 | 2–10 | 3–10 | 3–6 | 3–10* | 4–10 |
| Fe/Zn ct. wt. (g/sq.m.) | 2.99 | 2.55 | 2.5 | 2.92 | 3.06 | 3.49 |
| 6111Al crystal size (microns) | 6–24 | 6–20 | 6–15 | 4–12 | 3–6** | 3–6** |
| 6111Al ct. wt. (g/sq.m.) | 1.93 | 1.6 | 1.41 | 3.24 | 3.11 | 0.84 |

* = incomplete
** = dusty and incomplete

What is claimed is:

1. An aqueous acidic composition for forming a zinc phosphate, tungsten-containing coating on a metal substrate comprising about 0.4 to 3.0 grams per liter of zinc ion, about 4 to 20 grams per liter phosphate ion, about 0.005 to 10.0 grams per liter of tungsten and about 0.5 to 20 grams per liter of an accelerator selected from the group consisting of an oxime, hydroxylamine sulfate and mixtures thereof.

2. The aqueous acidic composition as defined in claim 1 wherein said accelerator is an oxime selected from the group consisting of acetaldehyde oxime and acetoxime.

3. The aqueous acidic composition as defined in claim 1 wherein said accelerator is hydroxylamine sulfate.

4. The aqueous acidic composition as defined in claim 1 wherein said zinc ion is present in an amount of about 0.8 to 1.2 grams per liter.

5. The aqueous acidic composition as defined in claim 1 wherein said phosphate ion is present in an amount of about 4.0 to 7.0 grams per liter.

6. The aqueous acidic composition as defined in claim 1 further comprising about 0.1 to 5.0 grams per liter of fluoride ion.

7. The aqueous acidic composition as defined in claim 1 further comprising about 0 to 2.5 grams per liter of manganese ion.

8. The aqueous acidic composition as defined in claim 1 further comprising about 1 to 10 grams per liter of nitrate ion.

9. The aqueous acidic composition as defined in claim 1 further comprising a metal ion selected from the group consisting of calcium and magnesium ions.

10. The aqueous acidic composition as defined in claim 1 further comprising an additional accelerator selected from the group consisting of hydrogen peroxide, sodium nitrobenzene sulfonate, and chlorate ion present in an amount of from 0.005 to 5.0 g/l.

11. The aqueous acidic composition as defined in claim 1 wherein said oxime is selected from the group consisting of oximes that are soluble and stable in aqueous acidic compositions and do not prematurely decompose and lose activity at a pH of between 2.5 and 5.5 for a sufficient time to accelerate the formation of zinc phosphate coating on metal substrates.

12. An aqueous acidic concentrate comprising about 10 to 100 grams per liter of zinc ion, about 50 to 400 grams per liter of phosphate ion, about 0.005 to 15.0 grams per liter of tungsten and as an accelerator, about 10 to 400 grams/liter of an accelerator selected from the group consisting of: an oxime, hydroxylamine sulfate, and mixtures thereof.

13. The aqueous acidic concentrate as defined in claim 12 wherein said accelerator is an oxime selected from the group consisting of acetaldehyde oxime and acetoxime.

14. The aqueous acidic concentrate as defined in claim 12 wherein said accelerator is hydroxylamine sulfate.

15. The aqueous acidic concentrate as defined in claim 12 wherein said zinc ion is present in an amount of about 16 to 20 grams per liter in the concentrate.

16. The aqueous acidic concentrate as defined in claim 12 wherein said phosphate ion is present in an amount of about 90 to 120 grams per liter in the concentrate.

17. The aqueous acidic concentrate as defined in claim 12 wherein said oxime is present in said amounts of from about 10 to 40 grams per liter in the concentrate.

18. The aqueous acidic concentrate as defined in claim 12 further comprising fluoride ion present in the concentrate in an amount of about 2 to 50 grams per liter.

19. The aqueous acidic concentrate as defined in claim 12 further comprising manganese ion present in the concentrate in an amount of about 4 to 40 grams per liter.

20. The aqueous acidic concentrate as defined in claim 12 further comprising nitrate ion present in the concentrate in an amount of about 10 to 200 grams per liter.

21. The aqueous acid concentrate as defined in claim 12 further comprising a metal ion selected from the group consisting of calcium and magnesium ion.

22. The aqueous acidic concentrate as defined in claim 12 further comprising an additional accelerator selected from the group consisting of: hydrogen peroxide, sodium nitrobenzene sulfonate, and chlorate ion in an amount in the concentrate to result in an amount of additional accelerator from 0.005 to 5.0 g/l in an aqueous acidic composition formed by diluting the aqueous acidic concentrate.

23. A process for forming a zinc phosphate, tungsten-containing coating on a metal substrate comprising contacting the metal with an aqueous acidic zinc phosphate, tungsten-containing composition comprising about 0.4 to 3.0 grams per liter of zinc ion, about 4 to 20 grams per liter phosphate ion, about 0.005 to 10.0 grams per liter of tungsten and about 0.5 to 20 grams per liter of an accelerator selected from the group consisting of an oxime, hydroxylamine sulfate and mixtures thereof.

24. The process as defined in claim 23 wherein said oxime is selected from the group consisting of acetaldehyde oxime and acetoxime.

25. The process as defined in claim 24 wherein said oxime is present in an amount of about 1 to 5 grams per liter.

26. The process as defined in claim 23 wherein said aqueous acidic zinc phosphate composition contains about 0.8 to 1.2 grams per liter of zinc ion.

27. The process as defined in claim 23 wherein said aqueous acidic zinc phosphate composition contains about 4 to 7 grams per liter of phosphate ion.

28. The process as defined in claim 23 wherein said aqueous acidic zinc phosphate composition contains about 0.1 to 5.0 grams per liter of fluoride ion.

29. A metal substrate containing from 0.5 to 6.0 grams per square meter ($g/m^2$) of a zinc phosphate, tungsten-containing conversion coating applied by contacting the metal with an aqueous acidic zinc phosphate composition comprising about 0.4 to 3.0 grams per liter of zinc ion, about 4 to 20 grams per liter phosphate ion, about 0.005 to 10.0 grams per liter of tungsten and about 0.5 to 20 grams per liter of an accelerator selected from the group consisting of an oxime, hydroxylamine sulfate and mixtures thereof.

30. The metal substrate of claim 29 wherein the metal is selected from the group consisting of ferrous metals, steel, zinc and zinc alloys, aluminum and aluminum alloys and mixtures thereof.

31. The metal substrate of claim 30 wherein the steel substrate is selected from the group consisting of galvanized steel, steel alloys, and mixtures thereof.

32. An aqueous acidic composition for forming a zinc phosphate, tungsten-containing coating on a metal substrate comprising about 0.8 to 1.2 grams per liter of zinc ion, about 4.9 to 5.5 grams per liter of phosphate ion, about 0.03 to 0.05 grams per liter of tungsten, about 0.25 to 1.0 grams per liter of fluoride ion, about 0.5 to 0.9 grams per liter of manganese ion, about 1.0 to 5.0 grams per liter of nitrate ion, and as accelerators about 0.5 to 1.5 grams per liter of acetaldehyde oxime or hydroxylamine sulfate or mixtures thereof.

33. The aqueous acidic composition as defined in claim 32 wherein the acetaldehyde oxime is present in an amount of about 0.5 to 1.5 grams per liter.

* * * * *